United States Patent [19]

Jackson et al.

[11] Patent Number: 4,789,429

[45] Date of Patent: Dec. 6, 1988

[54] METHOD OF MAKING MECHANICAL PULP

[75] Inventors: Michael Jackson, North Vancouver, Canada; Knut O. Danielsson, Stockholm; Bo G. S. Falk, Jäfälla, both of Sweden

[73] Assignee: Sunds Defibrator Aktiebolag, Sweden

[21] Appl. No.: 78,180

[22] PCT Filed: Oct. 7, 1986

[86] PCT No.: PCT/SE86/00454

§ 371 Date: May 28, 1987

§ 102(e) Date: May 28, 1987

[87] PCT Pub. No.: WO87/03022

PCT Pub. Date: May 21, 1987

[30] Foreign Application Priority Data

Nov. 6, 1985 [SE] Sweden ..... 8505229

[51] Int. Cl.[4] ..... D21B 1/16; D21D 1/30; D21K 3/26

[52] U.S. Cl. ..... 162/241; 162/26; 162/28

[58] Field of Search ..... 162/19, 23–26, 162/28, 78, 83

[56] References Cited

U.S. PATENT DOCUMENTS

| | | | |
|---|---|---|---|
| 3,016,324 | 1/1962 | Textor | 162/28 |
| 3,388,037 | 6/1968 | Asplund et al. | 162/28 |
| 3,446,699 | 5/1969 | Asplund et al. | 162/28 |
| 3,467,574 | 9/1969 | West | 162/26 |
| 4,279,694 | 7/1981 | Fritzvold et al. | 162/28 |
| 4,294,653 | 10/1981 | Lindhahl et al. | 162/28 |

FOREIGN PATENT DOCUMENTS 1145107 4/1983 Canada .

*Primary Examiner*—David L. Lacey
*Assistant Examiner*—K. M. Hastings
*Attorney, Agent, or Firm*—Lerner, David, Littenberg, Krumholz & Mentlik

[57] ABSTRACT

A method for producing mechanical pulps which are useful for producing coated light weight paper, magazine paper and the like, is disclosed, which includes preheating lignocellulose-containing material in the presence of impregnation chemicals, refining the preheated lignocellulose-containing material utiilizing a pair of counter-rotating refining discs under pressure, bleaching the thus produced partially refined lignocellulose-containing material, and refining the bleached material in a second refining step utilizing a pair of refining discs, one of which is stationary and the other which is rotating under pressure.

7 Claims, No Drawings

METHOD OF MAKING MECHANICAL PULP

FIELD OF THE INVENTION

The present invention relates to methods of manufacturing mechanical pulps. More particularly, the present invention relates to methods of manufacturing mechanical pulps from lignocellulose-containing materials, and particularly in which the pulps are intended for the production of coated paper having a low grammage, such as so-called LWC paper (light weight coated), magazine paper or similar such paper.

BACKGROUND OF THE INVENTION

In connection with the production of such coated papers or LWC papers, the properties of the pulps so utilized must meet certain very strict requirements. The reason for this is primarily because the paper must have high density, low roughness, low porosity, as well as high strength. Furthermore, a uniform surface structure of these papers is of particular importance.

Paper of this type normally includes both chemical and mechanical pulps. The traditional mechanical pulp component used in this paper has been a groundwood pulp. However, as an alternative, thermomechanical pulp (TMP) has been used in recent years, but with limited success. Experience has thus proven that the employment of such TMP as a mechanical pulp component, even at low freeness values, results in a certain unevenness in the surface structure of the paper. This, in turn, gives rise to poor coating and, thus, to unacceptable printability. It has only been possible until now to avoid these problems by the paper manufacturer taking special steps to either modify or eliminate entirely the negative effects of that fraction in the thermomechanical pulp which constitutes long fibers. This long fiber fraction thus includes long, rigid and unworked fibers, which have a negative effect on the surface structure of the papers produced therefrom.

Most recently, chemically modified TMP (CTMP) has arisen as an attractive alternative to TMP as a component of the mechanical pulp in such LWC-papers and papers of similar quality. It has thus been found that CTMP improves the strength and binding properties thereof, and permits a reduction in the aforenoted problems with long fiber fractions. This is due to the fact that the mild chemical pretreatment used therein substantially improves both the defibering capability of the wood material and the tendency of the fibers in the long fiber fraction of the pulp to swell. These fractions, in turn, provide for a lower shives content and improved flexibility and ductility for the long fibers in CTMP, as compared to TMP.

Both the TMP and CTMP intended for use in LWC-papers and the like are generally manufactured by refining in one or more steps, and then screening and bleaching the refined material. The energy consumption in such a process is relatively high, and considerable equipment for dewatering and washing is required. Therefore, the search has continued for improved methods of producing such papers.

SUMMARY OF THE INVENTION

In accordance with the present invention, these and other objects, including simplification of the equipment and reduction in the energy consumption while maintaining, or even improving, pulp quality and the production of such coated papers and the like have now been accomplished. More particularly, in accordance with this invention, this has now been accomplished by applicants' discovery of a method for producing a mechanical pulp product useful for the production of coated paper and the like from lignocellulose-containing material which includes preheating the lignocellulose-containing material in the presence of impregnation chemicals so as to produce a preheated lignocellulose-containing material, refining the preheated lignocellulose-containing material in a first refining step employing a pair of counter-rotating refining discs under pressure so as to produce a partially refined lignocellulose-containing material, bleaching the partially refined lignocellulose-containing material in the presence of bleaching chemicals of high concentrations so as to produce a bleached lignocellulose-containing material, and refining the bleached lignocellulose-containing material in a second refining step utilizing a pair of refining discs in which one of the pair of refining discs is stationary and the other of the pair of refining discs is rotating under pressure so as to produce a refined lignocellulose-containing material.

In accordance with a preferred embodiment of the method of the present invention, the method includes screening the refined lignocellulose-containing material. In another embodiment, refining in the first refining step is carried out so as to produce a partially refined lignocellulose-containing material having a freeness value measured by CSF of between about 150 and 300. In a preferred embodiment, the refining in the second refining step is carried out so as to produce a refined lignocellulose-containing material having a freeness value measured by CSF of between about 50 and 150. In a particularly preferred embodiment, the bleaching step is carried out employing a bleaching chemical such as a peroxide or a dithionite, and the bleaching step is carried out in order to produce a bleached lignocellulose-containing material having an ISO-brightness above about 70. In a particularly preferred embodiment, preheating is carried out in the presence of an impregnation chemical such as sodium sulfite or sodium bisulfite. Preferably, the preheating step is carried out at a PH in the range of about 6 and 12.

In accordance with another embodiment of the method of the present invention, preheating of the lignocellulose-containing material is carried out at a preheating temperature of between about 105° and 145° C. In accordance with another embodiment, the bleaching step is carried out at a concentration of between about 30 and 45%, and in another embodiment, refining in the second refining step is carried out at a concentration of between about 25 and 45%.

In accordance with the overall method of the present invention, the refining process is thus carried out in two separate steps with an intermediate bleaching step therebetween. Therefore, subsequent to impregnation and preheating of the raw material in the form of wood chips, initial refining is carried out in a double-disc refiner, that is, a refiner in which two counter-rotating refining discs are utilized. Bleaching of the pulp at high concentration is then carried out and, subsequently, a second refining step is conducted at high concentration in a disc-refiner of the single-disc type, i.e., one with one stationary and one rotating disc. In a preferred embodiment, the pulp is then subjected to screening. In accordance with this invention, the development of the light-scattering coefficient is maximized in the first refining step. It is thus generally known that double-disc refiners yield a higher light scattering coefficient than do single-disc refiners. Furthermore, due to the subsequent use of the bleaching step, the pulp is then easily dewatered so that the high pulp concentration required for bleaching can be obtained with a single dewatering apparatus. Furthermore, energy consumption can be reduced on an overall basis, since the second refining step can be carried out on pulp which has already been bleached. The Shives content of the pulp can also be minimized by utilizing a single disc refiner in that final refining step.

DETAILED DESCRIPTION

The present invention can be more fully appreciated with reference to the following detailed description. In particular, in a preferred embodiment, raw materials in the form of wood chips are subjected to pretreatment by washing, chemical impregnation and preheating, all in a conventional manner. It is preferred that sodium sulfite ($Na_2SO_3$) or mixtures of sodium sulfite and sodium busilfite ($NaHSO_3$) be utilized as the impregnation chemicals, preferrably within the pH range of about 6 to 12. The temperature of the lignocellulose materials are increased up to temperatures of from 105° to 145° C. in the preheating step.

Subsequent to pretreatment in this manner, the material is then subjected to refining under pressure in a double-disc refiner. Refining in this manner in this first step thus yields a pulp with a freeness value, according to CSF, of from about 150 to 300. This pulp is then relatively easy to dewater. The pulp can thus be pumped to the bleaching step, where it is dewatered to the desired concentration, preferably from about 30 to 45%. The dewatering equipment can therefore be simple, and there is thus a rather low investment cost associated therewith. Thereafter, the chemicals required for the bleaching are added. Bleaching is preferably carried out with peroxide or dithionite, to an ISO-brightness of greater than about 70.

After the bleaching step, the pulp is washed, and then subjected to the second refining step, which is carried out at high concentration, generally at between about 25 and 45%, and is driven to a freeness value, according to CSF, of from about 50 to 150.

Since the second refining step is carried out subsequent to bleaching, the energy consumption for such refining is reduced. The bleaching step has thus rendered the pulp easier to be processed to the desired quality. The second refining step is preferably carried out under an overpressure in a single-disc refiner which is preferably equipped with a device for obtaining accurate gap adjustment and gap control, and in this manner it is possible to minimize the shives content of the pulp, and at the same time control the shortening of the fiber length to the desired mean fiber length of the pulp, at the desired energy consumption, at least within certain limits. Subsequent to the second refining step, the pump is screened and cleaned, by conventional means, before the pulp is then ready to be transferred to a paper mill for the manufacture of LWC-paper, or paper of similar quality.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for producing a mechanical pulp product from lignocellulose-containing material comprising pretreating said lignocellulose-containing material in the presence of impregnation chemicals so as to produce a pretreated lignocellulose-containing material, refining said pretreated lignocellulose-containing material in a first refining step employing a pair of counter-rotating refining discs under pressure so as to produce a partially refined lignocellulose-containing material having a freeness value measured by CSF of between about 150 and 300 so as to maximize the light-scattering coefficient of said lignocellulosecontaining material, bleaching said partially refined lignocellulose-containing material in the presence of bleaching chemicals at a pulp concentration of between about 30 and 45 percent so as to produce a bleached lignocellulose-containing material having an ISO-brightness above about 70, and refining said bleached lignocellulose-containing material in a second refining step utilizing a pair of refining discs in which one of said pair of refining discs is stationary and the other of said pair of refining discs is rotating under pressure so as to produce a refined lignocellulose-containing material having a freeness value measured by CSF of between about 50 and 150 so as to minimize the shives content of said refined lignocellulose-containing material.

2. The method of claim 1 including screening said refined lignocellulose-containing material.

3. The method of claim 1 wherein said bleaching is carried out employing a bleaching chemical selected from the group consisting of peroxide and dithionate.

4. The method of claim 1 wherein said pretreating of said lignocellulose-containing material is carried out in the presence of an impregnation chemical selected from the group consisting of sodium sulphite and sodium bisulphite.

5. The method of claim 4 wherein said pretreating of said lignocellulose-containing material is carried out at a pH in the range of between about 6 and 12.

6. The method of claim 1 wherein said pretreating of said lignocellulose-containing material comprises preheating of said lignocellulose-containing material at a preheating temperature of between about 105° and 145° C.

7. The method of claim 1 wherein said refining of said bleached lignocellulose-containing material in said second refining step is carried out at a pulp concentration of between about 25 and 45 percent.

* * * * *

UNITED STATES PATENT AND TRADEMARK OFFICE

CERTIFICATE OF CORRECTION

PATENT NO. : 4,789,429

DATED : December 6, 1988

INVENTOR(S) : Jackson *et al*

It is certified that error appears in the above-identified patent and that said Letters Patent is hereby corrected as shown below: Title page:

ABSTRACT, line 6, "utiilizing" should read --utilizing--.

Column 3, line 58, "pump" shoudl read --pulp--.
Column 4, line 27, delete "about".

Signed and Sealed this

Eleventh Day of July, 1989

*Attest:*

*Attesting Officer*

DONALD J. QUIGG

*Commissioner of Patents and Trademarks*